United States Patent [19]

Perkins et al.

[11] Patent Number: 5,056,462

[45] Date of Patent: Oct. 15, 1991

[54] COATING SYSTEM WITH CORRECTION FOR NON-LINEAR DISPENSING CHARACTERISTICS

[75] Inventors: Jeffrey A. Perkins, Lorain; Jack A. Redilla, Amherst, both of Ohio

[73] Assignee: Nordson Corporation, Westlake, Ohio

[21] Appl. No.: 441,820

[22] Filed: Nov. 27, 1989

[51] Int. Cl.[5] ..... B05C 19/06

[52] U.S. Cl. ..... 118/683; 118/674; 118/308; 118/324; 118/DIG. 5

[58] Field of Search ..... 118/674, 679, 683, 309, 118/324, 308, DIG. 5

[56] References Cited

U.S. PATENT DOCUMENTS

| | | | |
|---|---|---|---|
| 3,862,414 | 1/1975 | Algeri | 250/206 |
| 4,013,037 | 3/1977 | Warning, Sr. et al. | 118/324 |
| 4,060,649 | 11/1977 | Coleman | 427/79 |
| 4,075,976 | 2/1978 | Clayton | 118/324 |
| 4,166,246 | 8/1979 | Matt | 328/5 |
| 4,249,478 | 2/1981 | Gruener | 118/683 |
| 4,357,900 | 11/1982 | Buschor | 118/324 |
| 4,380,967 | 4/1983 | Matt | 118/669 |
| 4,431,690 | 2/1984 | Matt et al. | 118/324 |
| 4,433,237 | 2/1984 | Matt | 118/682 |
| 4,500,937 | 2/1985 | Matt | 361/153 |
| 4,557,787 | 12/1985 | Mansfield et al. | 118/683 |
| 4,636,401 | 1/1987 | Yamazaki et al. | 427/39 |
| 4,797,301 | 1/1989 | Ardley et al. | 427/8 |
| 4,828,218 | 5/1989 | Medlock | 118/663 |
| 4,829,793 | 5/1989 | Holder et al. | 118/674 |

*Primary Examiner*—Michael Wityshyn

*Attorney, Agent, or Firm*—Wood, Herron & Evans

[57] ABSTRACT

A coating system is provided with a controller which transforms a demand signal responsive to the speed, relative to the dispensing apparatus, of an object to be coated, into a control signal which adjusts for the non-linear output characteristics of the flow of coating powder through the dispensing apparatus to cause the material to be dispensed with a uniformity that is corrected for the non-linear relationship between those output characteristics and the speed of the object. In the preferred embodiment, the system corrects for the non-linear characteristics of different powder pumps in dispensing different powder coating materials upon objects carried by variable speed conveyors. A plurality of stair-step tables are stored in the memory of the controller. Each table represents a different selectable powder pump to provide a desired powder pump output characteristic. A digital pulse counter signals the conveyor speed by periodically sending a speed count signal to the controller memory which is periodically gated with a selected stored table to set the level of the control signal which determines the powder flow of the pumping apparatus.

16 Claims, 4 Drawing Sheets

COATING SYSTEM WITH CORRECTION FOR NON-LINEAR DISPENSING CHARACTERISTICS

The present invention relates to coating systems, such as powder coating systems, and, more particularly, to dispensing apparatus and methods for controlling coating material dispensing rates in such systems to achieve uniform coating upon objects which move relative to the dispensing devices at speeds which tend to vary, such as objects carried upon variable speed conveyors past powder dispensing guns.

BACKGROUND OF THE INVENTION

In the application of coating materials to objects carried upon conveyors through coating stations, variations in the speed of the conveyor will affect the uniformity of the applied coating unless the rate at which the coating is dispensed onto the objects to be coated varies precisely in relation to the speed of the conveyor. The problem of controlling the dispensing rate of the coating material where the conveyor speed tends to vary has been approached by proportionately varying control signals to the dispensing apparatus in relation to the conveyor speed. This approach has been satisfactory where the dispensing apparatus responds linearly to such signals as is often the case in many applications. For example, in the hot-melt adhesive dispensing system described in the commonly assigned U.S. Pat. No. 4,431,690, such a control system is employed. U.S. Pat. No. 4,431,690 is hereby expressly incorporated herein by reference.

In applications such as powder coating systems, air driven venturi powder pumps which supply the powder coating material may not respond linearly to the control air pressure or other control input to the pumps. In addition, different pumps may have unique response characteristics due to differences in internal geometries and structures and in the particular powder coating materials being applied. As a consequence, changes in conveyor speed cannot be accommodated by proportionately changing the control air pressure, or other control signal or input, in direct response to the conveyor speed. For example, in processes for applying super-absorbent powders to diapers in a diaper manufacturing line, the characteristics of the powder coating materials and the powder pumps for transporting the powder coating materials usually result in a response to control inputs or signals by the powder coating material transporting and dispensing apparatus which is not sufficiently linear to achieve a sufficiently uniform powder coating deposition on objects carried by variable speed conveyors.

In many powder spray applications such as the diaper coating example discussed above, as the speed of the conveyor which carries the objects to be coated varies, as it will when increasing to full operating speed upon startup, the controller responds by linearly varying a control signal, often in the form of control air pressure, to a powder pump. The output of the powder pump, however, has not, in prior art powder coating systems, responded in a linear relation to the control signal, and not, consequently, in linear relation to the conveyor speed. The result has been that the application of the coating has not been uniform in relation to the speed of the conveyor.

Thus, there exists a need for a powder coating system control which will accommodate variations in conveyor speed to maintain coating uniformity in coating systems in which powder pump or coating material characteristics result in a failure of the system to respond proportionately to signals which are directly related to conveyor speed.

SUMMARY OF THE INVENTION

A primary objective of the present invention is to provide a coating system which is controllable to uniformly apply coating material to objects moved relative to a coating material dispensing device at speeds which can vary. A more particular objective of the present invention is to provide for the control of the powder pump of a powder spray system to accommodate non-linear characteristics of the powder pump or of the powder coating material being dispensed upon objects carried by a conveyor so that the powder coating material is dispensed uniformly in linear relation to variable conveyor speed.

According to the principles of the present invention, a coating system is provided in which dispensing characteristics, such as those of the powder pump or of the pumped material in a powder coating system, are stored in the form of a function of the speed of an object being coated relative to the dispensing apparatus to impose a correcting curve on the control input or signal to the powder pump which will correct for the non-linear characteristics of the powder pump or of the applied material, for example, to cause the coating to be deposited uniformly and independent of the speed of the object.

According to the preferred embodiment of the present invention, a plurality of correction functions is stored, each representing different material pumping characteristics in a powder coating system. The different characteristics may be those due to differences among pumps or among the powder materials. Each stored curve or function is separately selectable for use in automatically correcting the control signal to the powder pump to cause the coating material to be dispensed linearly in relation to a material demand which is proportional to the conveyor speed. In the preferred embodiment, a plurality of sets of digital values, each representing points on one of the characteristic curves, is stored in an EPROM, with each curve representing one of a plurality of different dispensing conditions which may be due to different pump and material combinations. Each of the functions representing the different conditions is selectable so that the corrective action of the controller is appropriate for the pump and material combination or other configuration of the system being controlled.

The curves are stored as a staircase step function in a lookup table stored in the EPROM. The EPROM contains passive logic which transforms a digital conveyor speed signal into a control signal having a value which will cause the dispensing device to dispense coating directly proportional to the conveyor speed. The conveyor speed is measured by a pulse counter which counts pulses, each of which represents a fixed increment of conveyor movement within a fixed time interval, and sets a latch which stores the count as a digital representation of the speed measurement. The stored count is then gated through the EPROM and to a digital-to-analog converter for output to the air pressure regulator which supplies control air to the powder pump.

The system provided in accordance with the principles of the present invention enables a powder coating system to operate to uniformly coat objects on a variable speed conveyor even though the system may be operated with different powder pumps or powder coating materials which result in non-linear powder flow characteristics in the particular system.

These and other objects and advantages of the invention will be more readily apparent from the following detailed description of the drawings.

DESCRIPTION OF THE DRAWINGS

Referring to FIG. 1, a powder coating system 10 is illustrated which is provided with a controller 11 for controlling the dispensing of fluidized powder from a dispensing unit 12 onto a substrate 13 carried by a conveyor 14. The controller 11 generally functions to control the rate at which fluidized powder is supplied to dispensing unit 12 and onto substrate 13 in a response to the relative movement between the dispensing unit 12 and the substrate 13.

Figure 1:
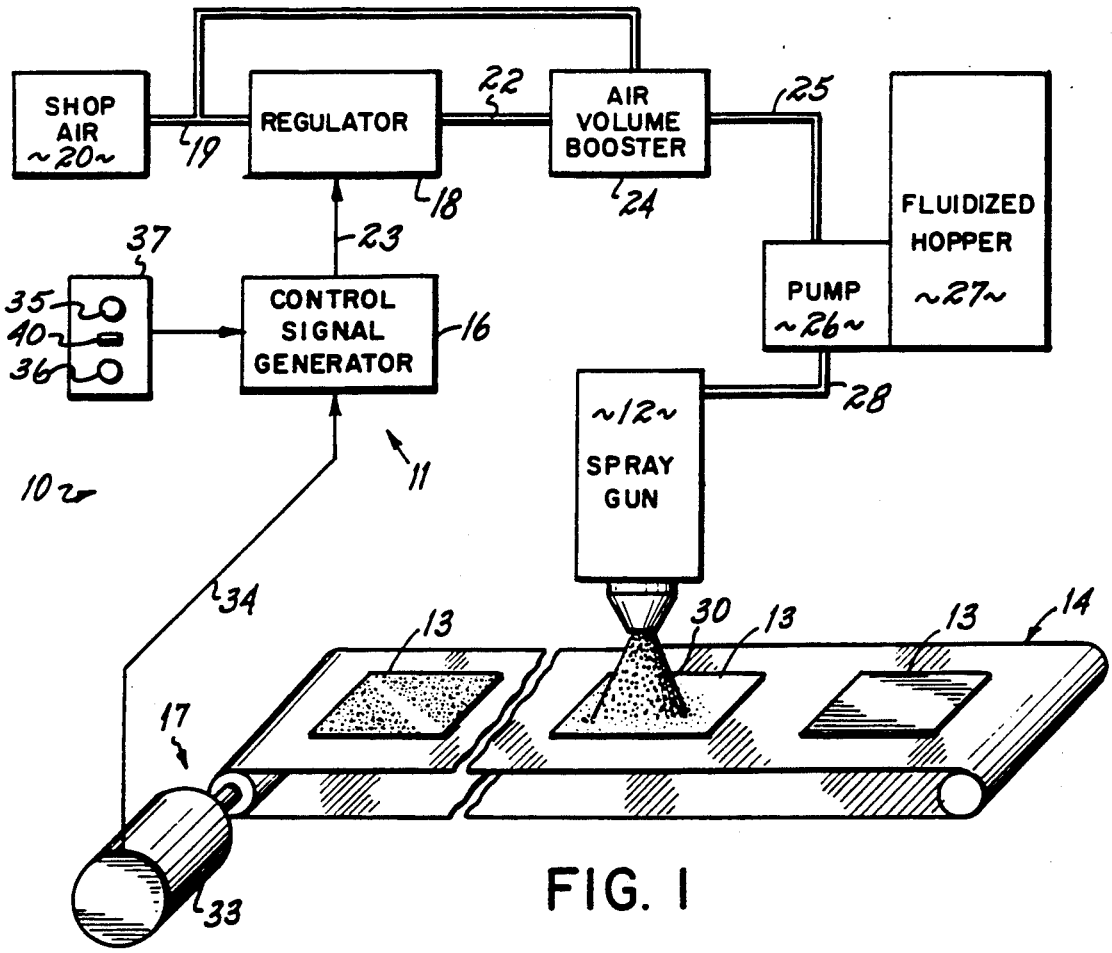
FIG. 1 is a block diagram of one preferred embodiment of a coating system provided with a controller according to principles of the present invention.

The controller 11 includes control signal generating device 16, a sensor 17 and flow regulator 18. Sensor 17 senses the relative movement between substrate 13 and dispensing unit 12 and generates an article speed or movement signal reflective of this sensed relative movement of the conveyed objects with respect to the dispensing device. Control signal generating device 16 receives the speed signal from sensor 17, computes the rate of relative movement from the conveyor speed signal, uses the computed rate of relative movement to retrieve a preselected flow rate from memory, and outputs a control signal necessary to produce the preselected flow rate with the powder pump and powder coating material being employed in the system. The control signal is input to regulator 18 to produce, through booster 24, a powder flow rate from pump 26 which varies linearly with to the rate of relative movement between the dispensing unit 12 and the substrate 13 so that the amount of dispensed powder per unit length of substrate conveyed past the dispensing device is substantially constant.

The regulator 18 is supplied with shop air through a supply line 19 connected to the source of shop air 20. The regulator 18 generates a pneumatic control signal on an output line or conduit 22 in response to an electrical control signal on a control signal line 23. The output line 22 is connected to the input of an air volume booster 24 which has a shop air input also connected from the shop air supply line 19. The booster 24 amplifies the pneumatic control signal on line 22 to output an amplified signal on output line 25 which is a multiple of that on line 22.

As depicted in FIG. 1, regulator 18 is operable to regulate the rate of flow of control signal air from source 20 through lines or conduits 22 and 25 to a pump 26. In one preferred embodiment, pump 26 is a Transfer Pump Part No. 601,352 manufactured by Nordson Corporation of Amherst, Ohio. The pump 26 is mounted on a fluidized powder hopper 27 and operates to deliver fluidized powder from the hopper 27 through a powder delivery line 28 to the dispensing unit 12. The dispensing unit 12 is, in the illustrated embodiment, a powder spray gun which operates to spray the fluidized powder onto objects such as the substrate 13. The fluid used to drive pump 26 typically is air from the shop air supply 20. Pump 26 pulls fluidized powder 30 by suction from the hopper or container 27 through the delivery line or conduit 28 to dispensing unit 12, where it is sprayed onto substrate 13. The spray gun 12 may be of the type which can be turned on or off in conjunction with the activation of the pump 26 to intermittently apply powder materials such as is shown in U.S. Pat. No. 4,600,603.

The sensor 17 includes a pulse generator 33 positioned adjacent the conveyor 14 such that the movement of the conveyor 14 is incrementally encoded on an electrical signal and transmitted on a signal line 34 to the control signal generating device 16. The pulse generator 33 produces on the signal line 34 a conveyor speed signal of pulses appearing at a rate proportional to the speed of the conveyor 14, with each pulse representing an incremental unit of distance, so that the pulse frequency is a digital representation of conveyor velocity. Conveyor 14 is caused to move past dispenser 12 by a conventional conveyor drive (not shown in the drawings) well known in the art and not a part of the present invention.

The control signal generating device 16 also includes means to establish the level of the control signal representing the minimum flow rate permitted when the pump 26 and dispensing device 12 are activated. As such, the signal provided to regulator 18 varies the flow rate controlling signal above the minimum flow rate signal level. The purpose of the minimum signal level is to maintain the speed signal transmitted through conductors 23 to regulator 18 at a level large enough to produce a minimum controllable dispensing rate of material when the movement of the conveyor 14 relative to the gun 12 is small but greater than zero.

Similarly, a maximum signal level setting is provided to limit the control signal to a value which will produce a flow rate corresponding to the upper limit of the conveyor speed. The minimum and maximum flow rates are respectively programmed into control signal generating device 16 by turning the knob of a respective variable resistor 35 and 36 located on a panel 37 of the device 16. A manual/automatic mode selection switch 40 is also provided on the panel 37. The operation of the controls will be more specifically described in conjunction with the description of FIG. 3 below.

Figure 2A:
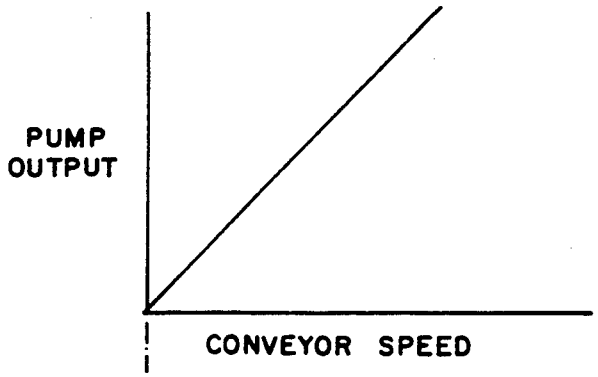
FIGS. 2A–2D are comparative graphs illustrating certain response characteristics of the system of FIG. 1 and of the prior art.

Referring to FIGS. 1 and 2A, the graph of FIG. 2A illustrates the ideal and desired output of the pump 26 on line 28 to the spray gun 12 and the flow of the fluidized powder 30 from the gun 12 onto the substrate 13 as a function of the speed of the conveyor 14. In the system 10, the control signal output on line 23 from the control signal generator 16 is a 0 to 20 milliamp signal which is output to the transducer or regulator 18. The transducer 18 is preferably a Fairchild Model T5200 transducer which produces a pneumatic control signal on its output 22 which is linearly related to the electrical signal on line 23. This pneumatic output signal is linearly amplified by the air volume booster 24 to an 18 to 90 psi signal on the control line 25 to the pump 26. The booster 24 is a Fairchild Model 20 air volume booster which boosts the input air signal on line 22 by a factor of six.

Figure 2B:
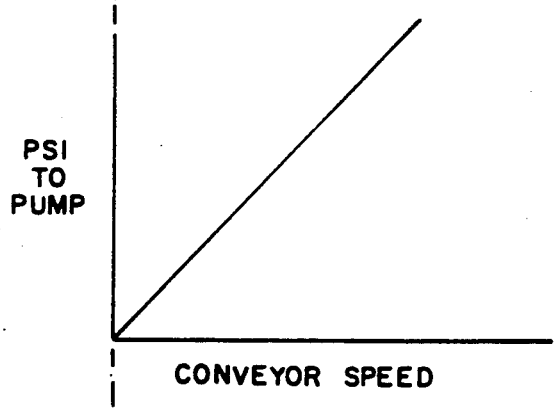
PRIOR ART FIG. 2B
Figure 2C:
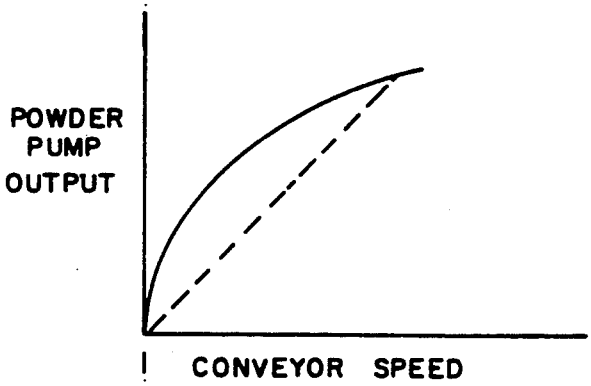
PRIOR ART FIG. 2C

In systems of the prior art where the air pressure supplied to the pump 26 relative to the conveyor speed is in accordance with the graph of FIG. 2B, the output of the pump 26 responds in accordance with a curve which is not linearly related to the conveyor speed, as, for example, in accordance with the solid line in the graph of FIG. 2C. In accordance with the present invention, the output of the pump 26 as a function of its control or input signal is determined empirically. This emperically determined pump output function can be plotted as a curve of powder pump flow output versus input air pressure. A curve can then be stored in the control signal generator 16 which is an inverse transformation of this pump output function curve.

Figure 2D:
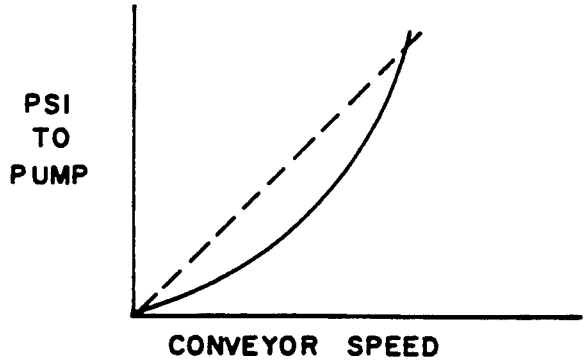

From this stored curve, the controller 16 develops an output signal on line 23 which is related to the conveyor speed in accordance with the graph of FIG. 2D rather than that of the graph of FIG. 2B. As a result, the non-linear characteristics of the pump 26 are corrected by a non-linear transformation of the conveyor speed signal to produce a control signal to the transducer or regulator 18 will produce a pump output which is linearly related to conveyor speed. Accordingly, the output of the pump 26 will conform to that of the graph of FIG. 2A rather than that of the graph of FIG. 2C. The circuit for achieving this is illustrated in the circuit drawing of the signal generator 16 of FIG. 3.

Figure 3:
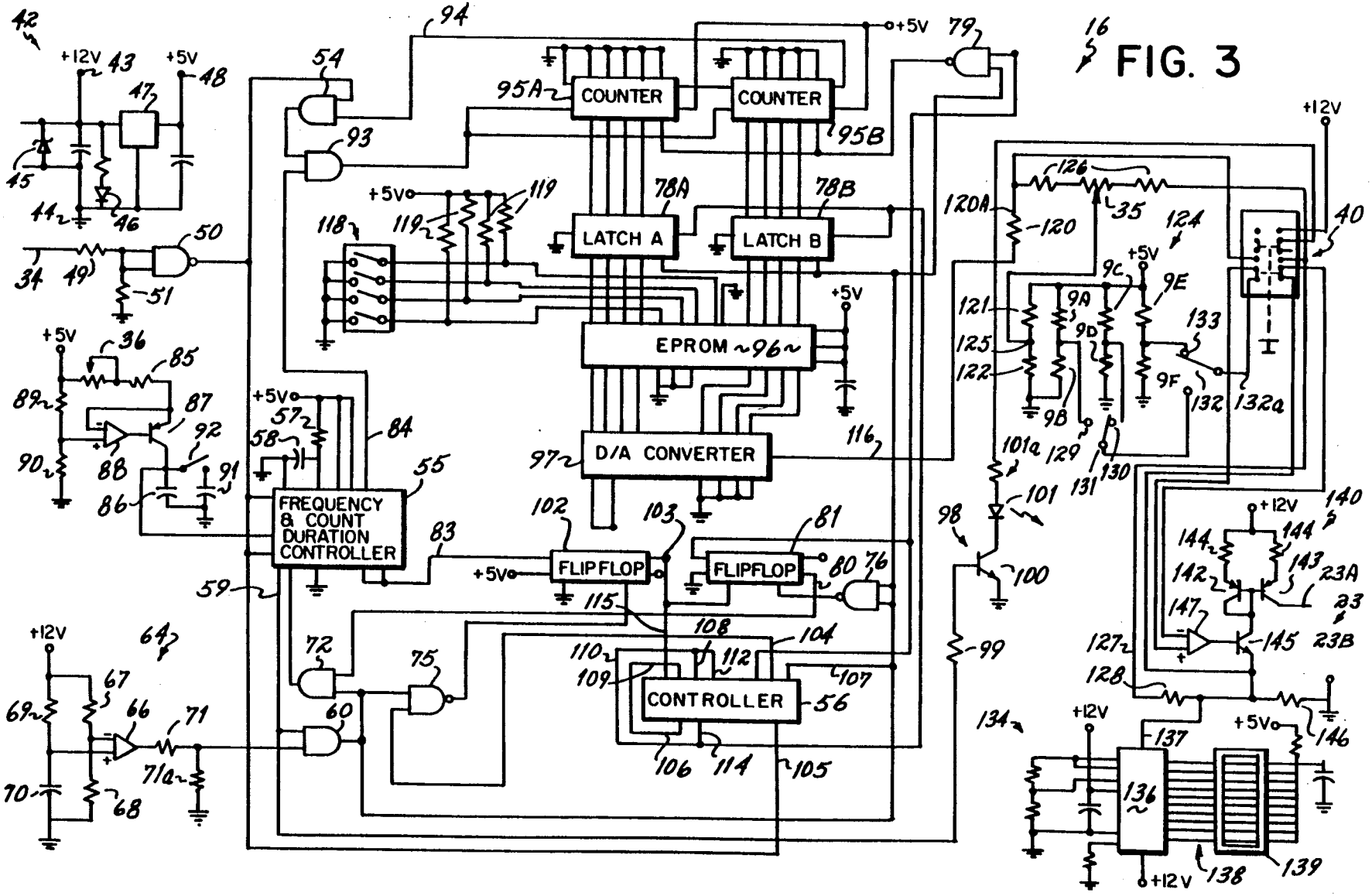
FIG. 3 is a circuit diagram of the controller of the system of FIG. 1.

Referring to FIG. 3, there is shown circuit diagram of the control signal generating device 16. A positive 12 volt DC power level is applied to the circuit generally for the purposes of activating those components requiring threshold voltages to be operational, and also, to provide reference voltages for differential amplifiers and other comparison circuit components. The circuit 42 is provided with a 12 volt output or power supply point 43 which is electrically connected to several positive 12 volt supply points throughout the circuit 16 so designated in FIG. 3. Similarly, the ground symbol 44 represents to one of ordinary skill in the art that every point in the circuit 16 disclosed in FIG. 3 where that symbol appears is connected to the common conductor or system ground. The 12 volt difference between positive voltage point 43 and the common connector 44 is maintained by zener diode 45 connected therebetween. The 12 volt supply voltage is applied to an activation indication circuit 42 causing a type 521-9216 light emitting diode (LED) 46 connected in series with a 2 kΩ resistor, between the 12 volt point 43 and a common conductor 44, incorporated in circuit 42 to illuminate with the activation of the device 16 so that, when voltage is being applied, the operator receives a visual indication that the control signal generating device 16 is energized.

In addition, the circuit 42 is provided with a regulated positive 5 volt DC supply 47 which has a 5 volt output terminal 48 which is electrically connected to several positive 5 volt supply points throughout the circuit 16 so designated in FIG. 3.

The signal from pulse generator 33 is transmitted through conductors 34 into the circuit 16 through a 51 kΩ resistor 49 to an input of a NAND gate 50 which, in the preferred embodiment, serves as a buffer-invertor. A 39 kΩ resistor 51 is interposed between the input of NAND gate 50 and ground and serves to present a true zero input when a signal is not applied to line 34. The tachometer signal from the pulse generator 33 which appears on line 34, being buffered and inverted by the gate 50, takes a form opposite that of the tachometer pulse signal. In the preferred embodiment, NAND gate 50 is a Motorola MC 14093BCP.

The output of NAND gate 50 is connected directly to an input of an AND gate 54, to a low frequency and counting duration controller 55, and to an output signal controller 56. The low frequency and counting duration controller 55 is a Motorola MC 14538BCP in the preferred embodiment of FIG. 3. An RC timing circuit including a 1 MΩ resistor 57 and a 1 μf capacitor 58 is connected to the frequency portion of the controller 55. If the frequency of pulses from NAND gate 50 is high enough, a triggering input, as a result of a pulse on line 34 during a minimum time since the last pulse on line 34, is generated. This results in a constant high signal appearing at an output 59 of the controller 55, enabling AND gate 60. Should the triggering pulses fall below the preset frequency such that controller 55 is not triggered within the time constant set, the signal provided to output 59 will be low, disabling AND gate 60, the output of which serves to enable certain components in the circuit of the control signal generating device 16. The other input of AND gate 60, which if low would serve to cause the output to be low, is connected to the output of disable circuit 64.

Upon energization of the circuit of the signal generator 16, 12 volts are applied to the disable circuit 64 causing two input signals to be provided to the differential amplifier 66. The first input is the result of a voltage divided between a 10 kΩ resistor 67 and a 51 kΩ resistor 68, and the second is a result of a voltage divided between a 10 kΩ resistor 69 and a 1 μf capacitor 70 establishing a time constant for triggering the differential amplifier 66. In the preferred embodiment, the differential amplifier 66 is a National LM324N, the resistor 69 is 10 kΩ and capacitor 70 is 1 μf.

After the time period established by resistor 69 and capacitor 70 has passed, amplifier 66 operates to provide a high signal through a 51 kΩ resistor 71 to an input of AND gate 60 which is connected through a 39 kΩ resistor to the ground 44. The AND gate 60, in conjunction with a high signal on line 59 from controller 55, causes the output of AND gate 60 to go high (and to remain high for the remainder of this description) providing high inputs to an AND gate 72, a NAND gate 75, the controller 56, a NAND gate 76, latches 78A and 78B of a latch 78 and a NAND gate 79.

Figure 4:
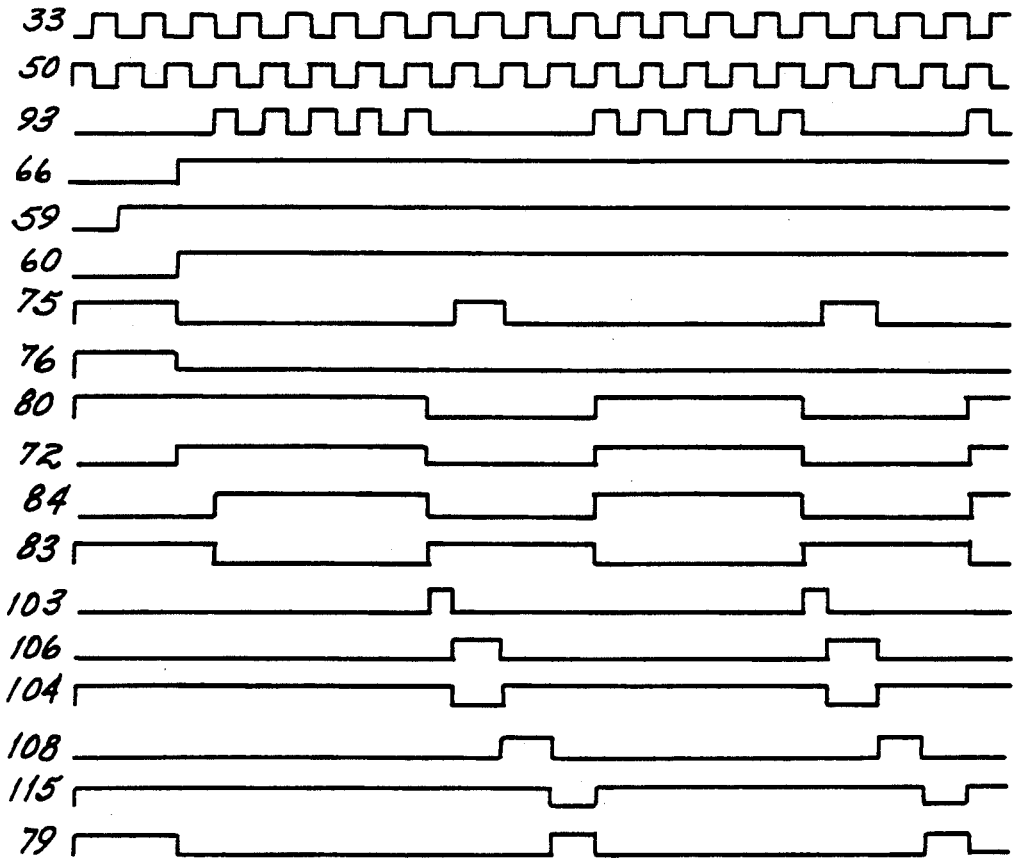
FIG. 4 is a timing diagram of certain signals in the circuit of FIG. 3.

The timing of the various signals referred to herein will be better understood by referring throughout this description to the waveforms of FIG. 4, each of which are identified by reference to its terminal or conductor reference number from FIG. 3.

When the AND gate 60 goes high, the AND gate 72 will have two high inputs, one of which is connected to the output of AND gate 60 and the other of which is connected to the Q output 80 of flipflop 81. The Q output 80 of flipflop 81 is high because its data, set, and reset inputs are all low as will be described in more detail hereinafter. With both of its inputs high, the output of AND gate 72 is high, providing a high input to the reset port of frequency and count duration controller 55. Controller 55 acts as a one shot multivibrator, providing a low signal at its negative output 83, and a high signal at its positive output 84, for a preselected time period. In the preferred embodiment, this time period is controlled by a 100 kΩ variable resistor 36. The combination of the variable resistor 36 and a 7.32 kΩ resistor 85 together with a 0.39 μf capacitor 86 acts as an RC time constant regulator such that controller 55 provides a low signal at its negative output 83 for the time constant period. Variation of the setting of this time interval effectively determines the maximum signal to be sent to the pump 26.

The preferred embodiment incorporates other electronic components into the RC circuit so that its time constant will not vary if apparatus 16 is used in an application having varying temperatures. This is accomplished by providing a substantially constant current through the RC circuit which includes resistors 36 and 85 and capacitor 86 form. A type 2N4403 transistor 87 is interposed between the combination of resistors 36 and 85 and capacitor 86. The base of transistor 87 is biased by a type LM244N differential amplifier 88 which has as one of its inputs a reference current developed by the voltage divider circuit containing a 412 Ω resistor 89 and a 9.76 kΩ resistor 90. This current is compared with the current developed through the variable resistor 36 and resistor 85 in the differential amplifier 88. When amplifier 88 is operational, the biasing applied to transistor 87 controls the amount of current conducted from its emitter to its collector and thus the charging rate of the capacitor 86. As the temperature varies, the capacitance of capacitor 86 will vary, varying the difference between the reference current determined by the resistors 89 and 90 and the current passing through resistor 85. The biasing of the base of transistor 87 thereby will also vary causing the current conducted from the emitter to the collector of transistor 87 to vary. Thus the time constant established by the variable resistor 36 and resistor 85 and capacitor 86 is maintained relatively constant.

A second capacitor 91 of 3.3 μf, connected in series with a normally open switch 92, is connectable in parallel with the capacitor 86 by the closing the switch 92. The addition of capacitor 91 allows a greater range of time constants to be selected. The RC time constant is such as to allow tachometer pulses to pass through an AND gate 93 from the AND gate 54 and NAND gate 50 by the positive output signal from output line 84 of controller 55 which is connected to an input of the AND gate 93.

As the low frequency controller 55 and power-up disable circuit 64 are changing from low to high, pulses passing through NAND gate 50 are also being supplied to the AND gate 54. The second input of AND gate 54 is a high signal provided by the output 94 of an 8-bit counter formed by two 4-bit counters 95A and 95B. This signal will always remain high until counters 95A and 95B have counted to their maximum count, whereupon output 94 will be provided with a low signal. The output 94 is connected to an input of the AND gate 54. Since the second input to AND gate 54 is high, the output of AND gate 54 will be generally identical to the output of NAND gate 50. Thus, the input to AND gate 93 will be virtually identical to the output of NAND gate 50. The second input to an AND gate 93 is normally low unless the count duration portion of controller 55 provides a high signal on its output 84. When the signal being applied to output 84 is high, the output of AND gate 93 will be virtually identical to the output of NAND gate 50. In other words, pulses will only be clocked into counters 95A and 95B while count duration portion of the controller 55 is providing a high signal at its output 84.

The rate of relative movement between the object 13 on the conveyor 14 and the gun 12 is computed by counters 95A and 95B which count pulses received only for a selected time period. For the maximum count to be reached, the conveyor speed must be sufficient to generate a maximum number of pulses at input 34 during the selected time period. Generally, it is desirable that a flow rate signal indicative of the upper limit of pump 26, be applied to regulator 18 when the conveyor velocity has reached this point. Since the time period for which pulses are counted in computing velocity remains unchanged, variations in line speed should, and will in accordance with the present invention, result in a linear or constant rate of increase or decrease in flow rate. The time period selected, therefore, establishes the desired velocity at which maximum flow rate, or the upper limit of pump output, will be reached and is set by the variable resistor 36. Minimum flow rate selection will be discussed in detail in connection with variable resistor 35.

In the preferred embodiment, counters 95A and 95B are each a Motorola MC 14516BCP. The inputs and outputs of the counters are arranged such that 95A and 95B are preset binary "up" counters which, when reset, are programmed to begin counting at zero and upward to a maximum value of 255. The output of counter 95A and 95B are tied directly to latches 78A and 78B which together serve as an 8-bit memory which stores the count from counters 95A and 95B until a new count from the counters 95A and 95B is ready to be received. The counters are reset to zero by an appropriate pulse from NAND gate 79, the inputs of which will be described in more detail in connection with controller 56. Thus, the sensed relative movement signal from input line 34 is stored by storing in latches 78A and 78B the pulses from line 34 counted during a timed interval in counters 95A and 95B. A rate of movement signal is then communicated to an EPROM 96 where, in response to that signal, an output signal value is derived from a look-up table, in accordance with a selected one of a plurality of stored correction curves, and transmitted to a digital-to-analog converter 97.

Indication circuitry 98 is also provided having an input connected to and activated by the output 59 of count duration controller 55 which is connected through a 10 kΩ resistor 99 to the base of a type 2N4401 switching transistor 100. The transistor 100 is connected in series with a LED 101 and a 1 kΩ resistor **101*a*, a circuit which is energized when the controller 16 is set in the automatic mode by switch 40. Thus, the LED 101 is illuminated when the controller 16 is in the automatic mode and the speed of conveyor 14 is above the minimum speed which will produce a pulse at line 34 within the time interval set by the timing circuit made up of resistor 57 and capacitor 58**.

If counters 95A and 95B have counted a maximum conveyor speed (a count of 255) before the end of the computation interval, a bar graph display circuit 134, described below, serves to notify the user of signal generating device 16 that such a maximum count was reached by a speed which is out of the range of the circuit 16. When such a completed count has been reached, a corresponding flow rate signal will be transmitted from the device 16 to the regulator 18. Pump 26 will generally, but need not necessarily, be at its upper limit or at a preselected maximum flow rate. By changing the count duration period by adjusting potentiometer 36, the desired rate of relative movement at which the maximum flow rate will occur is changed. For example, if maximum count and therefore maximum flow rate is reached while the substrate is moving at a desired rate, reduction of the time constant would vary the relation of maximum flow rate to substrate velocity, such that maximum flow rate would then not be reached until the substrate velocity had increased to the newly preset maximum value.

An appropriate output signal from controller 56 serves to reset the latches 78A and 78B. The NAND gate 75 serves to reset or enable a flipflop 102. The output of AND gate 60 serves as one input to NAND gate 75 and the negative output 104 of the first phase of quad-flipflop controller 56 serves as the other input of the NAND gate 75. In the preferred embodiment, flipflop 102 is a Motorola MC 14013BCP and quad-flipflop controller 56 is a Motorola MC 14175BCP. With two normally high inputs, the output of NAND gate 79 is low.

Flipflop 102 has low reset and high data input connected from the output 83 of the controller 55. Thus, a rising edge sensed at its clock input, which is connected from the output of the NAND gate 75, provides a high signal to output 103. A rising edge appears at the clock input of flipflop 102 when the output 83 of the controller 55 goes low during the time period of the preselected time constant and thereafter returns to its normally high level. When this occurs a high signal is applied to output 103 of flipflop 102 until a high signal appears at the reset input of flipflop 102 from the output of NAND gate 75. A high reset will occur when the signal provided to output 104 changes as is described in greater detail in connection with controller 56.

The high signal at output 103 of flipflop 102 is transmitted to the set input of the flipflop 81. In the preferred embodiment, the flipflop 81 is a Motorola MC 14013BCP. The output of AND gate 60 is a normally high output which is connected to an input of NAND gate 76, the output of which is connected to the reset input of flipflop 81. The negative output 80 of flipflop 81 is high when its data input is low, since the reset and set inputs are normally low. The normally high signal applied to output 80 of flipflop serves to enable controller 55. When a high signal is applied to output 103, the signal applied to output 80 goes low, causing a low input to be provided through AND gate 72 to controller 55 disabling it. When output 80 next goes high, controller 55 will be reset such that the next rising edge of the pulses provided from NAND gate 50 will serve to provide a high signal to output 83 for the duration of the time constant selected by way of potentiometer 36.

The high signal applied to output 103 of flipflop 102 is also transmitted to the data input of controller 56. Once this input becomes high, the next rising edge of the pulse signal from NAND gate 50 sensed at the clock input 105 of controller 56 will cause a high signal to be applied to output 106 and a low signal to be applied to output 104. The reset input 107 of controller 56 receives a normally high signal from the output of AND gate 60. With a low signal being applied to output 104, a high signal is applied to the reset input of flipflop 102. This eventually causes the signal applied to output 103 to become low.

On the next rising edge of the output of NAND gate 50 the signal applied to output 108 becomes high. As hereinbefore mentioned, controller 56 is a quad-flipflop device. The output 106 is connected to input 109. When the signal applied to output 106 is high, the signal applied to output 108 will become high on the next rising edge sensed at the clock input. A high signal at the output 108 of the controller 56 is connected to the line 110 to clock inputs of the latches 78A and 78B. In the preferred embodiment, latches 78A and 78B are each Motorola MC 14175BCP components. A signal on the clock input to the latches 78A and 78B forces the latches to store the current count being output of from the counters 95A and 95B.

The high signal applied to output 108 also is transmitted to inputs 112 and 114. Input 114 is the input to the fourth base of the quad-flipflop device contained in controller 56 and is only connected to output 108 for purposes of preventing a floating condition. With the input 112 sensing a high signal, the normally high signal applied to output 115 will become low on the next rising edge sensed at the clock input 105. When the output 115 goes low, a high signal is output from NAND gate 79 which serves to reset counters 95A and 95B.

When a high signal is applied to output 108, it serves to enable latches 78A and 78B causing the signal obtained from counters 95A and 95B to be stored in the latches 78A and 78B and an digital output signal reflective of the movement occurring during the timed signal from controller 55 to be generated through the table look-up logic of the EPROM 96 to digital-to-analog converter 97. In the preferred embodiment, converter 97 is a Analog Devices AD558JN. Converter 97 converts the digital signal obtained from latches 78A and 78B and transformed by the EPROM 96 and generates an analog signal on the output 116 which.

FIG. 4 discloses the logic timing diagram depicting various outputs of components contained in the circuit shown in FIG. 3, during two cycles of operation. As previously mentioned the time period selected by variable resistor 36 allows five pulses from NAND gate 50 to be counted. When the output of AND gate 60 goes high, one of the inputs to each of the circuit components 66, 72, 75, 76, and 79 is changed. On the next rising edge of the signal from NAND gate 50, output 84 becomes high and allows the output of AND gate 93 to reflect NAND gate 50 until 84 goes low. At that point the rate of movement is determined as the amount of movement and the time in which the movement occurred are known. The storage operation is completed when output 108 goes high which serves to latch the count. Between each counting operation outputs 79, 103, 104, 106 and 113 serve to reset the operation device to begin the next cycle. The next cycle begins when the output 115 returns to its normally high state.

The EPROM 96 stores sixteen tables, each of 256 values, each presenting a stairstep representation of a different output compensation curve. The curves may differ in that each may represent the adjustment needed to the output control signal on line 23 necessary to overcome the non-linear characteristics of a different pump or powder coating material as it flows through a pump. Examples of such curves are shown in FIG. 5.

Figure 5:
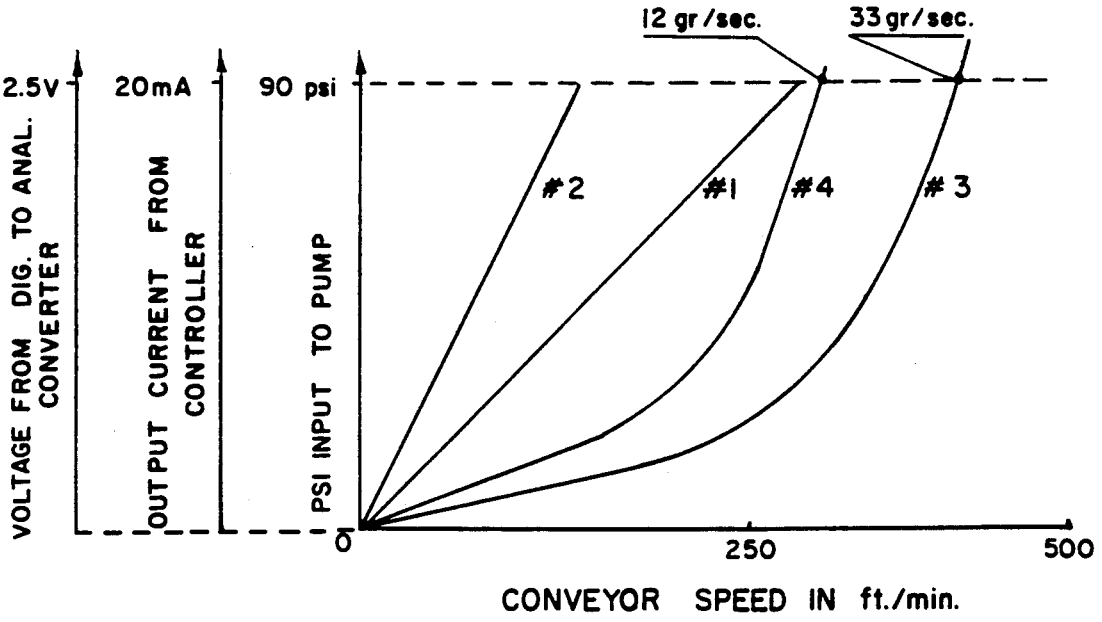
FIG. 5 is a graph illustrating a corrective curves applied to the operation of a coating system by the circuit of FIG. 3.

In FIG. 5, curve #1 is a linear curve which, when selected, essentially eliminates the effects of correction function providing a control signal to the pump a control signal or input which has a direct one-to-one relationship to the conveyor speed signal. Curve #2 is also a linear curve but with a slope which is twice that of curve #1, thus doubling the ratio of pump output to conveyor speed. This ratio can also be increased by changing the setting of the potentiometer 36.

Curve #3 of FIG. 1 is a non-linear curve which corrects for the non-linear output characteristics of one particular standard type of powder pump, in this case powder pump part no. 601,352 manufactured by the Nordson Corporation of Amherst, Ohio. Curve #4 is also a correction curve for another smaller powder pump similar to the pump of curve #3, but in which all dimensions are one-half of those of the pump of curve #3, producing a pump with a pumping cavity ⅛th the volume of the pump of curve #3. Curves #3 and #4 are determined empirically. As FIG. 5 shows, when the pneumatic control signal on air line 25 to the pump is at 90 psi, the pump of curve #3 will produce a maximum output of 33 grams of powder per second, while that of curve #4 will produce a maximum output of 12 grams of powder per second. This 90 psi pneumatic control signal is produced by an electrical control signal on line 23 from the controller 16 of 20 milliamps, which is in turn produced by a signal on line 116 from the digital-to-analog converter 97 of 2.5 volts.

Connected to inputs so as to provide a means for selecting one of the sixteen stored curves is a four switch set of switches 118. Each switch applies a zero value, when closed on its respective input line to the EPROM 96. These inputs are maintained in the high state when the switches are open by 1 kΩ resistors 119. Each combination of the settings of the switches of the set 118 selects a different table stored within the EPROM 96. The EPROM 96 is programmed to generate a signal on its outputs to the digital-to-analog converter 97 corresponding to the conveyor speed from the latches 78A and 78B so as to impose the appropriate correcting value to the output signal on line 116 which will cause the output signal to compensate for the non-linearity of the system in accordance with the selected curve in the EPROM 96. The selection of the curve by the switch set 118 is made to correspond to the predetermined stored curve which corresponds to the correction needed for the particular pump or other configuration of the system.

The circuit 16 also contains comparison circuitry for comparing the signal received on output 116 to a preselected flow rate signal and generating a signal to regulator 18. The comparison is obtained by comparing the rate of signal received on output 116 of the digital-to-analog converter 97 and through a 49.9 kΩ resistor 120 to a preselected flow rate signal established by the divider circuit comprising 5.62 kΩ resistor 107 and 5.90 kΩ resistor 122 of the resistor network 124, providing a voltage reference at a point 125 for comparison with the output 110 of the digital-to-analog converter 97. The voltage comparison between output 116 and point 125 is preformed by applying the voltage from point 125 to the wiper of the 100 kΩ variable resistor 35 which is connected between a pair of 49.9 kΩ resistors 126 in series between the terminal 120A of resistor 120 and a signal line 127 which is connected through a resistor 128 and resistor 146 to ground.

The resistor network 124 includes three additional pairs of resistors 9A and 9B, 9C and 9D, and 9E and 9F respectively. The resistors 9A, 9C and 9E are respectively connected between the 5 volt source and reference points 121, 122 and 123 respectively, while the resistors 9B, 9D and 9F are connected between respective reference points 129, 130 and 131 and a common voltage connection. The three pairs of resistors cooperate with switches 131 and 132 to permit selection of the scale of the output signal of the signal generator 16. The selectable levels are provided with resistors 9A through 9F having the respective values of 1.91 kΩ, 49.9 kΩ, 5.62 kΩ, 5.90 kΩ, 11.3 kΩ, and 1.21 kΩ.

A LED bargraph type display 131 is provided to produce a visual indication of the output signal on line 23. The display 134 includes a driver 135 of type LM3914 having a signal input terminal 137, connected to the junction of resistors 128 and 146, and ten output lines 138 connected to the inputs of a type DSP1 MV57164 LED module 139. The module 139 generates an illuminated bargraph indication of values of the output signal current ranging from zero to 20 milliamps.

The output signal from the circuit 16 is delivered at the output line 23, the conductors of which are connected to the output terminals 23A and 23B of the circuit 16. The position of the automatic/manual push button selector switch 40 on the operator panel 37 (FIG. 1) selects the operating mode of the circuit 16. In addition, a pair of manual range selector switches 131 and 132 are provided on the circuit board of circuit 16. The common terminal of the switch 132 is connected to a contact **132*a* of the push-button switch 40 to be selectively connected to the positive input of amplifier 147 when the push-button switch 40 is in the manual mode. When the switch 132 is in its first position, point 133 at the junction of resistors 9E and 9F is connected to terminal 132*a*, and when the switch 132 is in its second position, the common of switch 131 is connected the terminal 132*a*. The setting of switch 131 applies either the voltage at the point 129 (the junction of resistors 9C ad 9D) or at the point 130 (the junction of resistors 9A and 9B) to the terminal 132*a* depending on the whether the switch 131 is in its first or second positions, respectively. This manual setting of the automatic/manual switch 40 allows the selection of one of three possible outputs to be applied to the amplifier 147**.

The switch 40 is a two position pushbutton switch having four electrically isolated double pole slide action contacts. The switch 40 is shown in FIG. 3 in the OUT or manual mode position. When the switch 40 is in the IN or automatic mode position, 12 volts is applied to the line to the resistor **101*a* through a first contact, the output of the potentiometer 35 (right one of the resistors of pair 126) is connected through the second pole to the negative input of an amplifier 147, and the input of the potentiometer 35 (left one of the resistors of the pair 126) is connected through a third pole to the positive input of the amplifier 147. The fourth pole of the switch 40** is not used.

When the switch 40 is in the OUT or manual mode position, the power to the LED circuit 98 is disconnected by opening the first pole circuit of the switch 40, the negative input of amplifier 147 is connected to the junction of resistors 128 and 146 through the second pole of the switch 40, and the resistor network 124 is connected by the third pole of switch 40 to replace the potentiometer circuit 35 on the positive input of the amplifier 147.

Variable resistor 35 sets a minimum flow rate signal and the slope of the output signal to the regulator 18. By adjusting variable resistor 35, the voltage comparison sensed will also include a minimum flow rate signal. Since the preselected minimum flow rate signal applied through variable resistor 35 does not add resistance to the signal path from the output 116, its effect on the point at which the present maximum flow rate occurs will not vary. This minimum signal represents the smallest signal applied to the pump 26 when the pump is activated to a non-zero value.

Referring again to FIG. 1, in the preferred embodiment, regulator 18 comprises a Fairchild model T5200 transducer which converts an electrical signal to a proportional 3 to 15 PSIG output pressure. Since the Fairchild transducer optimally operates on a current signal, a conversion circuit 140 is provided which serves to convert the voltage signal applied to its input to a proportional current signal applied to the transducer 18. The conversion circuit 140 includes a pair of 2N4403 transistors 142 and 143, connected at their bases with their emitters each connected through a 100 kΩ resistor 144 to the 12 volt supply. The collector of transistor 142 is connected to its base and the collector of the transistor 143 is connected to the conductor 23A of the output signal line 23. The common base connection is further connected to the collector of a 2N4401 transistor 145 which has its emitter connected to the junction of the resistors 128 and 146. The resistor 146 is a 127 Ω resistor connected from this junction to ground. The base of the transistor 145 is connected to the output of a LM224N differential amplifier 147 which produces the output signal to the circuit 140 which in turn amplifies and applies this output signal on the output conductor 23A.

In operation the movement sensed by tachometer 33 is received by counters 95A and 95B for the time period selected with controller 55. After the time period is completed the latch 78 is enabled storing the count, and presents it to converter 97. Latch 78 will present the same count until it is again enabled. Converter 97 converts the count signal into an analog voltage reflective of the rate of movement and presents this voltage to the comparison circuitry. The comparison circuitry compares the converter voltage to the voltage at point 125, which is reflective of a preselected rate of fluid flow. A signal reflective of the comparison is generated through variable resistor 35. This signal is converted from a voltage to a proportional current and transmitted to regulator 18. The signal transmitted to regulator 18 will not change until latch 78 is enabled.

Although the invention has been described in terms of the preferred embodiment where it is employed with a powder pump, those skilled in the art will recognize that other forms may be adopted within the scope of the following appended claims.

We claim:

1. A powder coating system for dispensing powder coating material upon objects carried by a conveyor with a uniformity that is corrected for a non-linear relationship between the material pumped by a pumping apparatus and the speed of the conveyor, said system comprising:

a powder pumping apparatus which pumps powder coating material to a dispensing device in response to a control input signal in accordance with output characteristics at which powder is pumped by the apparatus, the characteristics having a non-linear relationship with the control input signal;

means for sensing the speed of the conveyor and for generating a conveyor speed signal in response to and related to the sensed conveyor speed;

means for storing data related to the output characteristics of said pumping apparatus; and means for generating a control input signal to said pumping apparatus in response to said conveyor speed signal and the stored data, said control input signal generating means including means for trans forming said conveyor speed signal in accordanc with the output characteristics of said pumpin apparatus to produce a non-linear control inpu signal in response to which the output of sai pumping apparatus is linearly proportional to th conveyor speed signal.

2. The apparatus of claim 1 wherein:

said powder pumping apparatus includes a fluidizec powder pump responsive to a pneumatic contro input signal;

said sensing and conveyor speed signal generatin means includes means for generating a series o electrical pulses, the frequency of which is directl proportional to the speed of the conveyor, and fo communicating said pulses to said control inpu signal generating means;

said storing means includes a non-volatile memory device having stored therein a plurality of digital functions, each in the form of a stair-step table o data and each representing the inverse transformation of the output characteristics, in response to a control input signal, of said powder pumping apparatus in pumping a specified material to the device for dispensing upon objects upon the conveyor; and, said control input signal generating means includes:

register means for counting the electrical pulses of said sensing and conveyor speed signal generating means during successive regular intervals and for successively storing the count as a digital representation of the speed of the conveyor;

means for selecting one of the stored functions; and means for periodically gating the count stored in said register means with the selected function stored in said storing means to perform a table look-up of the stored data corresponding to the conveyor speed, and for setting the value of said generated control input signal in direct relationship with the product of the conveyor speed signal and the corresponding stored data.

3. The apparatus of claim 1 wherein:

said powder pumping apparatus includes a fluidized powder pump.

4. The apparatus of claim 3 wherein:

said pump is responsive to a pneumatic control input signal and said control input signal is a pneumatic control input signal.

5. The apparatus of claim 1 wherein:

said sensing and conveyor speed signal generating means is operative to produce an electrical conveyor speed signal.

6. The apparatus of claim 5 wherein:

said sensing and conveyor speed signal generating means includes means for generating a series of electrical pulses, the frequency of which is directly proportional to the speed of the conveyor, and for communicating said pulses to said control input signal generating means.

7. The apparatus of claim 6 wherein said control input signal generating means further comprises:

register means for counting the electrical pulses of said sensing and conveyor speed signal generating means during regular intervals and for storing the count as a digital representation of the speed of the conveyor.

8. The apparatus of claim 7 wherein said control input signal generating means further comprises:

means for periodically reading the count stored in said register means and, in response to the count, establishing from the data stored in said storing means a value of said generated control input signal which causes the pumping of the coating material at a rate directly proportional to the conveyor speed.

9. The apparatus of claim 1 wherein said control input signal generating means further comprises:

means for generating said control input signal in accordance with the inverse transformation of said output characteristics.

10. The apparatus of claim 9 wherein said control input signal generating means further comprises:

means for periodically performing a table look-up of the stored data corresponding to the conveyor speed, and for setting the value of said generated control input signal in direct relationship with the product of the conveyor speed signal and the corresponding stored data.

11. The apparatus of claim 1 wherein:

said storing means includes a non-volatile memory device having stored therein a digital function representing the inverse transformation of the output characteristics of said powder pumping apparatus in pumping a specified material to a dispensing device for dispensing upon objects upon the conveyor as a function of the control input signal.

12. The apparatus of claim 11 wherein said function is stored in the form of a stair-step table of data.

13. The apparatus of claim 11 wherein:

said non-volatile memory device has stored therein a plurality of digital functions, each representing the inverse transformation of the output characteristics of said powder pumping apparatus in pumping a specified material to the dispensing device for dispensing upon objects upon the conveyor as a function of the control input signal.

14. The apparatus of claim 1 wherein:

said data storing means includes means for storing data for a plurality of functions each representing the output characteristics of said powder pumping apparatus in pumping a specified material to a dispensing device for dispensing upon objects upon the conveyor as a function of the control input signal; and said system further comprises means for selectively enabling said control input signal generating means to generate said control input signal in accordance with a selected one of said functions.

15. A powder coating system for dispensing powder coating material upon objects with a uniformity that is corrected for a non-linearity between a dispensing rate and a control input signal, said system comprising:

means for transporting and dispensing a powder coating material to a dispensing device in response to a control input signal in accordance with output characteristics of the dispensing of the material through the transporting and dispensing means, the characteristics having a non-linear relationship with the control input signal;

means for generating a material demand signal;

means for storing data related to the output characteristics of said transporting and dispensing means; and means for generating a control input signal to said transporting and dispensing means in response to said demand signal and the stored data, said control input signal generating means including means for transforming said demand signal in accordance with the output characteristics of said transporting and dispensing means to produce a non-linear control input signal in response to which the output of said transporting and dispensing means is linearly proportional to the demand signal.

16. The system of claim 15 for dispensing the material upon objects on a conveyor with a uniformity that is corrected for the speed of the conveyor, said system further comprising:

means for sensing the speed of the conveyor, said material demand said demand signal in response to and related to the sensed conveyor speed.

* * * * *